United States Patent [19]

Kikuchi

[11] Patent Number: 4,965,981

[45] Date of Patent: Oct. 30, 1990

[54] SHIFTING APPARATUS FOR OBJECTS SUCH AS EGGS

[75] Inventor: Kouichi Kikuchi, Tsuyama, Japan

[73] Assignee: Kyowa Machinery Co., Ltd., Okayama, Japan

[21] Appl. No.: 400,007

[22] Filed: Aug. 29, 1989

[30] Foreign Application Priority Data

Sep. 3, 1988 [JP] Japan ..... 63-221061

[51] Int. Cl.[5] ..... B65B 5/08; B65B 35/56; B65B 39/12

[52] U.S. Cl. ..... 53/142; 53/246; 53/251; 53/534; 53/539; 53/544; 198/418.6; 198/468.8

[58] Field of Search ..... 53/246, 247, 248, 249, 53/250, 251, 255, 260, 530, 534, 539, 543, 142, 544; 198/418.6, 468.3, 468.8

[56] References Cited

U.S. PATENT DOCUMENTS

| | | | |
|---|---|---|---|
| 1,758,798 | 5/1930 | Lopez | 53/530 X |
| 3,148,761 | 9/1964 | Niederer et al. | 53/246 X |
| 3,374,600 | 3/1968 | Rademacher et al. | 53/251 X |
| 3,908,812 | 9/1975 | Graff | 53/543 X |
| 3,964,233 | 6/1975 | Thomas | 53/247 X |
| 4,051,652 | 10/1977 | Hirano et al. | 53/539 X |
| 4,199,050 | 4/1980 | Moller | 53/247 X |
| 4,231,213 | 11/1980 | Okazaki | 53/539 X |
| 4,360,099 | 11/1982 | Niederer et al. | 53/248 X |
| 4,603,772 | 8/1986 | Tomosue . | |

FOREIGN PATENT DOCUMENTS

| | | |
|---|---|---|
| 46-4778 | 2/1971 | Japan . |
| 60-110618 | 6/1985 | Japan . |

*Primary Examiner*—Robert L. Spruill
*Assistant Examiner*—Linda B. Johnson
*Attorney, Agent, or Firm*—William H. Eilberg

[57] ABSTRACT

A shifting apparatus for objects such as eggs comprises a plurality of holders slidably carried on a substantially horizontal holder guide which is vertically movable. When the holder guide assumes an upper position, the holders are maximally spaced from each other for receiving a corresponding number of objects from above. A pitch changing mechanism causes the holders to slide on the holder guide, so that the holders are minimally spaced from each other when the holder guide assumes a lower position. In the lower position of the holder guide, a discharging mechanism causes the holders to discharge the received objects into a container located below.

7 Claims, 5 Drawing Sheets

SHIFTING APPARATUS FOR OBJECTS SUCH AS EGGS

BACKGROUND OF THE INVENTION

1. Field of the Invention

This invention generally relates to handling of objects, in particular easily damageable objects such as eggs and fruits (apples, peaches, and so on). It more specifically relates to an apparatus for shifting such objects from an upper conveyor to each of containers successively transferred by a lower conveyor.

2. Description of the Prior Art

In automated handling of eggs for example, it is usual to employ a shifting apparatus which is used to shift, at each time, a predetermined number of eggs from an upper conveyor into each of containers (plastic or paper packages) successively transferred on a lower conveyor. Obviously, eggs are easily damageable, so that care must be taken not to allow the eggs to come into contact with each other during handling.

As is well known, egg containers have rows of constantly spaced seating recesses. A typical shifting apparatus for transferring eggs into such a container includes a row (or rows) of egg holders which receive eggs in a row (or rows) from the upper conveyor and discharge them onto each row (or corresponding rows) of seating recesses of the container. Such a shifting apparatus is disclosed for example in Japanese Patent Publication No. 46-4778 and Japanese Patent Application Laid-open No. 60-110618.

Naturally, the pitch or distance between each two adjacent seating recesses of egg containers should preferably be as small as possible to increase the number of eggs to be packed into each container. However, this gives rise to a problem that eggs must be arranged in a row at correspondingly small spacing during handling thereof before shifting into the container, so that the eggs are more likely to come into contact with each other with resultant damaging or breakage of some eggs.

The typical prior art shifting apparatus described above is designed to receive eggs in a row (or rows) at constant spacing and to discharge them into each of containers at the same spacing as received from the upper conveyor. Thus, the prior art shifting apparatus has a disadvantage that eggs are likely to be damaged if the eggs are to be densely packed.

On the other hand, there are various specifications for egg containers according to various sizes of eggs to be packed. Further, the egg packing pitch of containers even for identically sized eggs may differ slightly depending for example on container manufacturers.

The holders of the typical prior art shifting apparatus are arranged at fixed spacing. Thus, the shifting apparatus is applicable only to containers of a predetermined specification. Although it is possible to incorporate an adjusting mechanism to change the spacing between the holders, such an adjusting mechanism usually requires complicated adjusting operation.

SUMMARY OF THE INVENTION

It is, therefore, an objective of the present invention to provide a shifting apparatus for objects such as eggs which is capable of receiving the objects at larger spacing from an upper conveyor but discharging them at smaller spacing into each of successively transferred containers, thereby preventing the objects from coming into mutual damaging contact during handling thereof while enabling high-density packing of the same.

Another objective of the present invention is to enable easy adjustment of the shifting apparatus for application thereof to variously sized containers.

According to the present invention, there is provided an apparatus for shifting objects, such as eggs, from an upper conveyor to each of containers transferred by a lower conveyor, the apparatus comprising: substantially horizontal holder guide means extending transversely of the path of transfer of the containers between the upper and lower conveyors; displacing means for vertically moving the holder guide means between an upper position and a lower position; a plurality of holders carried by the guide means for receiving a corresponding number of objects from the upper conveyor when the holder guide means assumes the upper position, the holders being slidable on the holder guide means transversely of the transfer path; spacer means for always maintaining even spacing between the holders; pitch changing means for causing the holders to slide on the holder guide means in response to vertical movement of the holder guide means in a manner such that the holders are spaced maximally from each other when the holder guide means assumes the upper position but spaced minimally from each other when the holder guide means assumes the lower position; and discharging means for causing the holders to discharge the received objects into the container when the holder guide means assumes the lower position.

When the shifting apparatus described above is used for shifting eggs for example, the holders, which are slidable on the holder guide means, receive a row (or rows) of eggs at maximally increased spacing. Thus, it is possible to reduce the chance of the eggs coming into damaging contact with each other during transfer thereof by the upper conveyor and at the time of receiving the eggs from the upper conveyor.

On the other hand, the holders are caused to slide on the holder guide means when the latter approaches the lower discharging position, so that the spacing between the holders is rendered minimum at the time of discharging the eggs into the container. Thus, it is possible to provide high-density packing of eggs in the container.

It should be appreciated that the spacer means, which may be in the form of coil springs, serves to always keep even or uniform spacing between the holders even if the spacing is increased or decreased as a result of vertical movement of the holder guide means.

Preferably, the pitch changing means comprises inclined guide surface means which causes at least one end holder to progressively slide on the holder guide means toward the other end holder as the holder guide means approaches the lower discharging position. Advantageously, the shifting apparatus further includes adjusting means which functions to alter the position, particularly the pivotal position, of the inclined guide surface means. This adjusting means makes the shifting apparatus applicable to variously dimensioned containers.

Other objectives, features and advantages of the present invention will be fully understood from the following detailed description given with reference to the accompanying drawings.

DETAILED DESCRIPTION OF THE PREFERRED EMBODIMENTS

Figure 1:
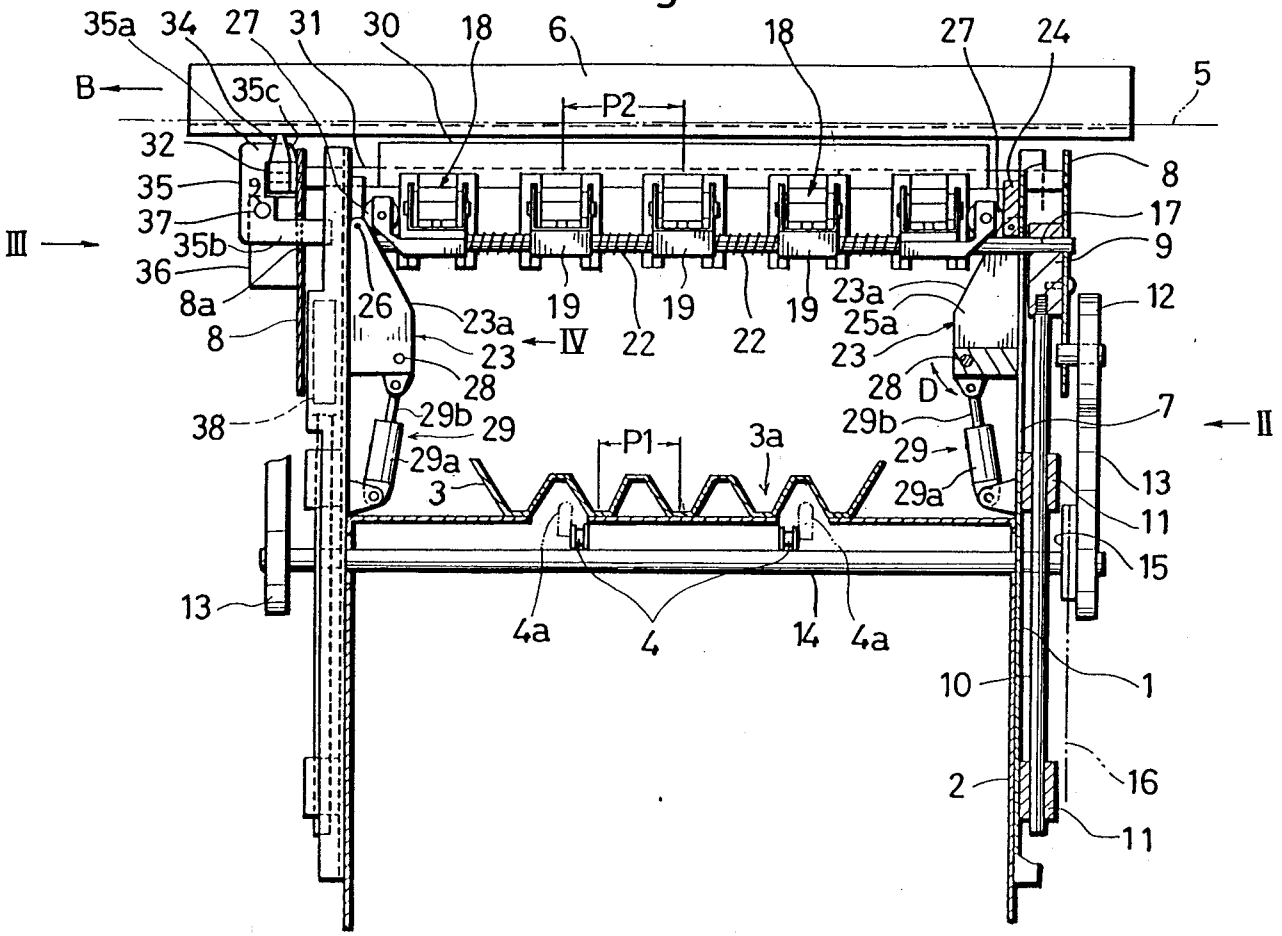
FIG. 1 is a front elevational view, partially in section, showing a shifting apparatus according to the present invention.
Figure 2:
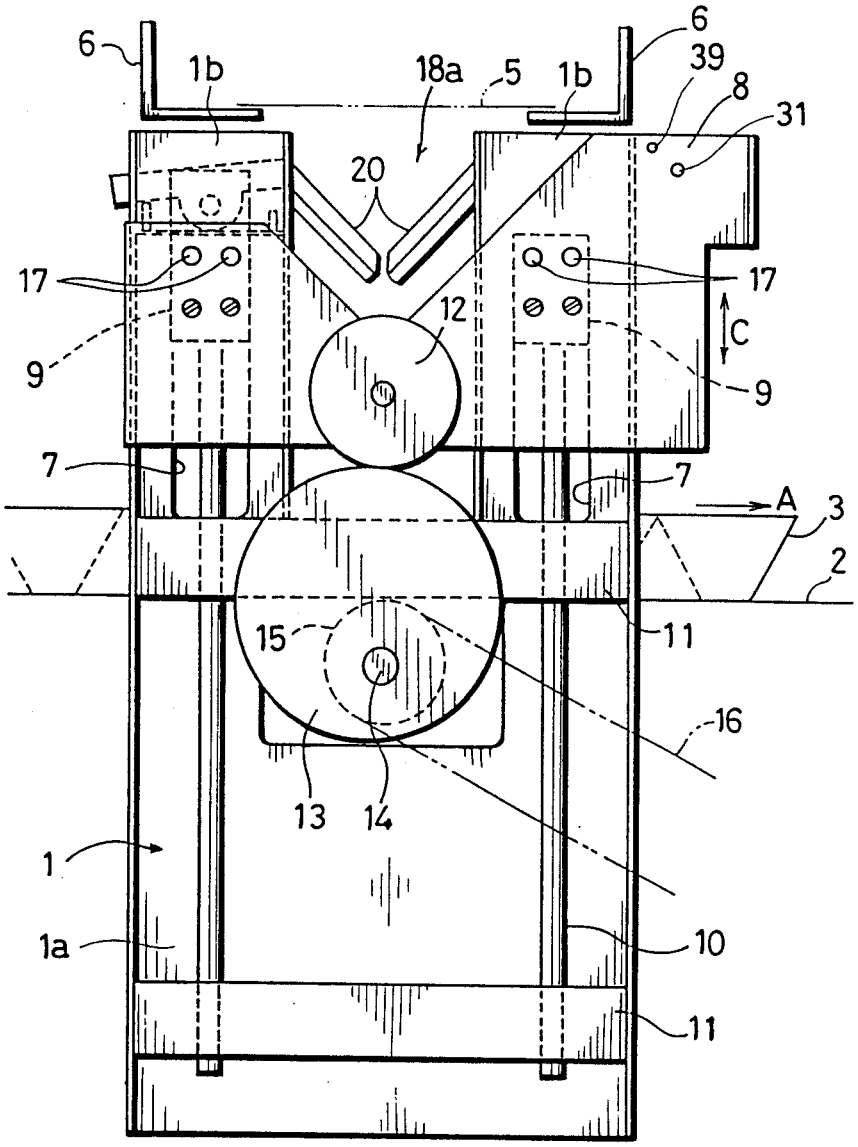
FIG. 2 is a side elevational view of the same shifting apparatus as seen in the direction of an arrow II in FIG. 1.
Figure 3:
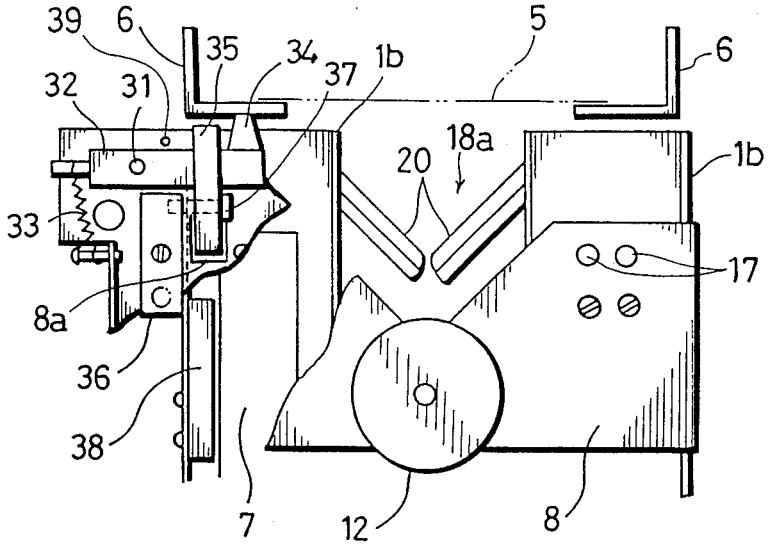
FIG. 3 is a fragmentary side view of the same shifting apparatus as seen in the direction of an arrow III in FIG. 1.

Referring now to FIGS. 1 to 3 of the accompanying drawings, there is illustrated a shifting apparatus according to the present invention as used for handling eggs as an example of easily damageable objects. The shifting apparatus includes a pair of stationary side plates 1 fixed to both sides of a container support 2. Each container 3 is transferred on the container support 2 between the stationary side plates 1, as indicated by an arrow A in FIG. 2.

The container 3 has rows of seating recesses 3*a* for receiving eggs E (see FIGS. 7 and 8) therein. The seating recesses in each row are arranged at a constant spacing or pitch P1.

The transfer of the container 3 is performed by a lower conveyor 4 which may be in the form of a chain conveyor having feed projections 4*a* for engagement with the container from below, as illustrated in FIG. 1. On the other hand, the transfer of the eggs is achieved by an upper conveyor 5 of any suitable type which moves along a stationary frame 6 transversely of the transfer path of the container, as indicated by an arrow B in FIG. 1.

Each stationary side plate 1 has a lower base portion 1*a*, and a bifurcated upper portion which includes a pair of upstanding fork blades 1*b*, as best shown in FIG. 2. Each fork blade 1*b* has a vertically elongated opening 7 for the purpose to be described hereinafter.

A pair of movable side plates 8 are arranged outwardly of the respective stationary side plates 1. Each movable side plate is fixed to two mounting blocks 9 which in turn are fixed to the respective upper ends of two vertical guide rods 10. These guide rods are slidably guided by horizontal support beams 11 fixed to each stationary side plate.

Each movable side plate 8 rotatably carries a cam follower roller 12 which is always kept in contact with a cam disc 13 located immediately below. This cam disc is mounted eccentrically to each end of a cam shaft 14 which is driven into rotation by an external motor (not shown) via a chain wheel 15 and a chain 16. Thus, the movable side plate 8 is displaced vertically up and down upon rotation of the cam disc 13, as indicated by a double headed arrow C in FIG. 2. Alternatively, the movable side plate may be moved up and down by means of a known cylinder device (not shown).

The pair of movable side plates 8 are connected together by two pairs of horizontal guide rods 17 extending transversely of the transfer path of the container 3. The pairs of horizontal guide rods 17 extend through the respective elongated openings 7 of the stationary side plates 1 for connection to the respective mounting blocks 9. Thus, the elongated openings 7 allow the horizontal guide rods 17 to move vertically together with the movable side plates 8.

The two pairs of horizontal guide rods 17 are used to slidably support a plurality (five for example) of holders 18. These holders are designed to receive a row of eggs E (see FIGS. 7 and 8) from the upper conveyor 5 above, and to discharge them into the container 3 below.

Figure 5:
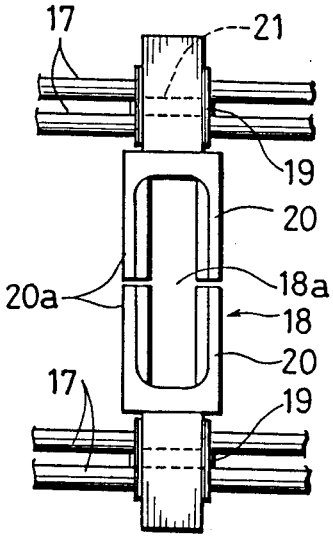
FIG. 5 is a plan view showing a holder.
Figure 6:
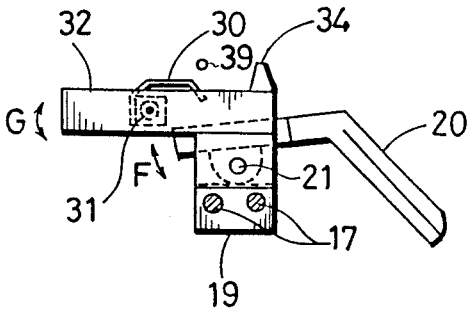
FIG. 6 is a side view showing the same holder.

As better shown in FIGS. 5 and 6, each holder 18 includes a pair of sliders 19 each of which is slidably mounted on a corresponding pair of horizontal guide rods 17, and an opposed pair of pivotal arms 20 each of which is pivotally mounted on a corresponding slider 19 by means of a pin 21. Each pivotal arm 20 has a fork portion 20*a* which defines a seating recess 18*a* for an egg in cooperation with the fork portion of the other pivotal arm of the same pair.

Compression coil springs 22 are interposed between the respective holders 18, as shown in FIG. 1. These springs function to always maintain even spacing or pitch P2 between the respective holders.

Figure 4:
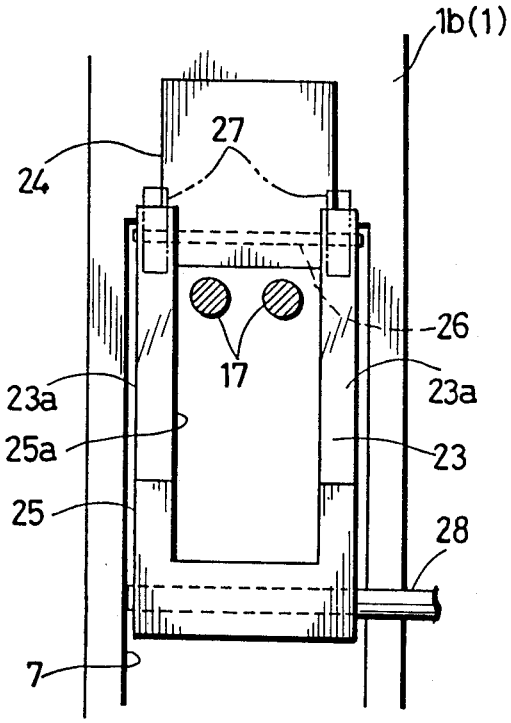
FIG. 4 is a enlarged side view showing a pitch changing member as seen in the direction of an arrow IV in FIG. 1.

A pitch changing member 23 is mounted internally on each fork blade 1*b* of each stationary side plate 1 at the vertically elongated opening 7 thereof, as illustrated in FIGS. 1 and 4. Apparently, there are four such members in total, and each two of four pitch changing members 23 form a pair associated with a corresponding pair of horizontal guide rods 17.

As shown in FIG. 4, each pitch changing member 23 comprises an upper portion 24 fixed to the corresponding fork blade 1*b* at the upper end of the elongated opening 7, and a pivotal lower portion 25 positioned in alignment with the elongated opening 7 and pivotally connected to the upper portion 24 by means of a pin 26. According to the illustrated embodiment, the lower portion 25 is substantially U-shaped to provide a passage 25*a* for allowing vertical movement of the corresponding pair of horizontal guide rods 17. Further, the lower portion 25 is formed with a pair of inclined guide surfaces 23*a* which extend downwardly inwardly (see FIG. 1).

As shown in FIG. 1, each slider 19 of each end or terminal holder 18 carries a pair of rollers 27 which come into rolling contact with the inclined guide surfaces 23*a* of the associated pitch changing member 23 (see also FIG. 4). Thus, as the movable side plates 8 are vertically displaced downward, the inclined guide surfaces 23*a* cause the end holder to slide on the horizontal guide rods 17 progressively toward the other end holder, thereby reducing the pitch P2 between the respective holders. The coils springs 22 serve to always maintain uniform pitch P2 between the respective holders 18 in spite of such variation in this pitch, as described hereinbefore.

Figure 7:
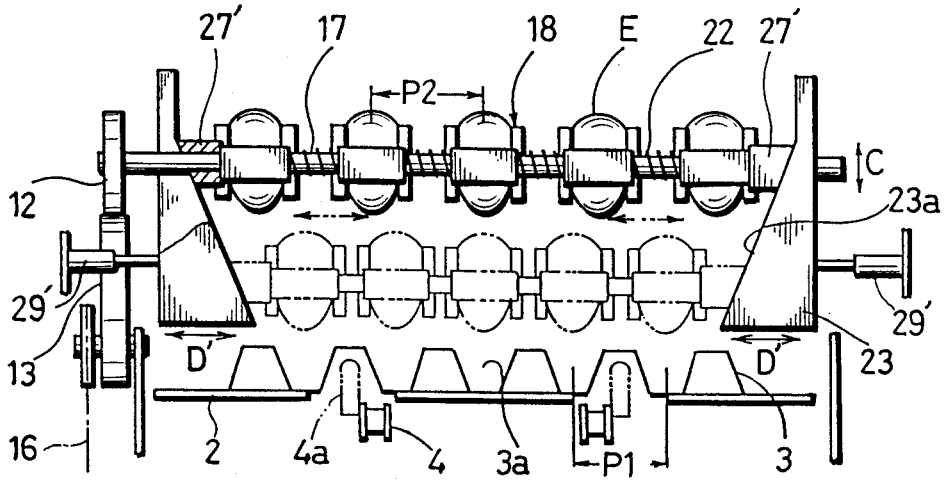
FIG. 7 is a schematic front view showing the operation of the shifting apparatus.

Obviously, the pitch P2 between the respective holders 18 is maximum when the movable side plates 8 assume an upper position shown in FIG. 1, whereas this pitch becomes minimum when the movable side plates assume a lower position (the phantom line position in FIG. 7). The maximum pitch of the holders is larger than the seating recess pitch P1 of the container 3 to enable damage-free reception of eggs from the upper conveyor 5. On the other hand, the minimum pitch of the holders must be equal to the seating recess pitch P1 of the container to enable proper discharging and packing of the eggs relative to the container. Preferably, the minimum pitch of the holders should be adjustable to conform to the seating recess pitch of variously dimensioned containers.

According to the illustrated embodiment, the two pitch changing members 23 of each same side are connected together by means of a tie rod 28 to form a pair, so that each pair of pitch changing members 23 may be simultaneously adjusted by a single adjusting device 29. This adjusting device comprises a cylinder body 29*a* pinned to the inner side of a corresponding stationary side plate 1, and a retractably protractable cylinder rod 29*b* pinned to the pivotal lower portion 25 of one pitch changing member 23. Thus, by properly operating the adjusting device 29, the slanting guide surfaces 23*a* are caused to pivot about the pins 26, as indicated by an double headed arrow D in FIG. 1. As a result, the minimum pitch between the respective holders 18 is changed to be equal to the seating recess pitch P1 of any particular container.

The operation of the adjusting device 29 may be controlled in response to a signal from an unillustrated sensor device (not shown) which detects the seating recess pitch P1 of each container 3 during transfer thereof. Alternatively, the adjusting device may be manually operated.

Figure 8:
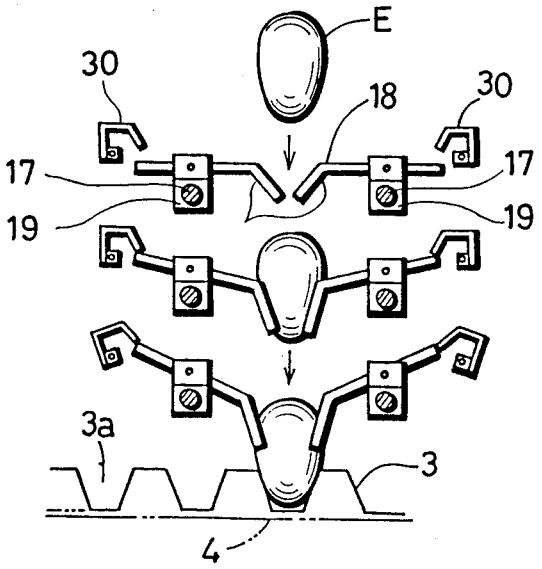
FIG. 8 is a schematic side view also showing the operation of the shifting apparatus.

According to the embodiment illustrated in FIGS. 1 to 6, the respective holders 18 are commonly operated by a single discharging mechanism which acts only on one pivotal arm 20 of each holder. In this case, the other pivotal arm of the holder is held substantially at a fixed pivotal position by suitable stopper members (not shown). However, it is of course possible to employ two identical discharging mechanisms which act on the respective pivotal arms of each holder, as schematically illustrated in FIG. 8.

As shown in FIGS. 1, 3 and 6, the discharging mechanism comprises an elongated stopper member 30 positioned slightly above the rear end (non-forked end) of one pivotal arm 20 of each holder for engagement therewith. The stopper member 30 is fixed on a shaft 31 which extends in parallel to the horizontal guide rods 17 behind the stationary side plates 1 (see FIGS. 2 and 3). One end of the shaft 31 is rotatably received by one movable side plate 8 (see FIGS. 1 and 2), while the other end of the shaft 31 rotatably projects through the other movable side plate 8 for connection to a lever 32 which is located laterally outside the other movable side plate (see FIG. 1).

The lever 32 is pivotable together with the stopper member 30 about the shaft 31, as indicated by a double headed arrow G in FIG. 6. The lever has a rear end which is always pulled downward by a tension spring 33 (see FIG. 3). Further, the lever has a front end provided with an abutment projection 34 which is directed upward for abutment with the upper stationary frame 6 when the movable side plates 8 assume the upper position shown in FIG. 3.

Normally, the lever 32 is arrested by a hook member 35 pivotally mounted by means of a pin 37 to a mount 36 which is fixed on the outer surface of the relevant movable side plate 8, as shown in FIG. 1 and 3. More specifically, the hook member 35, which is always spring-biased to the position shown in FIG. 1, has an upper leg 35*a* for engagement from above with the lever 32. The hook member further has a lower leg 35*b* which penetrates through an opening 8*a* of the relevant movable side plate 8.

Under the lower leg 35*b* of the hook member 35, there is provided a limit member 38 fixed on the relevant stationary side plate 1, as shown in FIGS. 1 and 3. Thus, when the movable side plates 8 are lowered, the lower leg 35*b* of the hook member comes into abutment with the limit member 38. As a result, the upper leg of the hook member 35 is pivoted out of arresting engagement with the lever 32 whose front end is allowed to pivot upward under the biasing force of the tension spring 33 (FIG. 1). On the other hand, when the movable side plates 8 are raised to return to the upper position shown in FIGS. 1 and 3, the abutment projection 34 of the lever 32 comes into contact with the stationary frame 6, so that the front end of the lever 32 is pivoted downward to be arrested again by the upper leg 35*a* of the hook member 35. To enable returning pivotal movement of the lever 32, the upper leg 35*a* of the hook member 35 has an inclined wedging end 35*c* (FIG. 1) for contact with the lever 32. Indicated at 39 is a limit rod which is positioned slightly above the stopper member 30 for limiting upward pivoting thereof, thereby limiting downward pivoting of the relevant pivotal arm 20 of the holder.

In operation, an egg is dropped from the upper conveyor 5 (FIG. 3) to each holder 18 when the movable side plates 8 assume the upper position. In this condition, the stopper member 30 (together with the lever 32) assumes a substantially horizontal position. Thus, one pivotal arm 20 of the holder is pivoted slightly downward under the weight of the received egg, but such pivoting is limited by engagement thereof with the stopper member 30. As a result, the egg is supported by the holder 18 whose other pivotal arm is held substantially at a fixed pivotal position. It should be appreciated that the pitch P2 between the respective holders (i.e., the eggs supported thereby) is maximum at the time of egg reception.

Upon descent of the movable side plates 8, the stopper member 30 together with the lever 32 is pivoted upward to allow the relevant pivotal arm 20 of the holder 18 to pivot downward, thereby allowing the egg to be discharged into the container 3. At this time, the pitch P2 between the respective holders is reduced to be equal to the seating recess pitch P1 of the container 3, as described hereinbefore.

The upward pivotal movement of the stopper member 30 is limited by the limit rod 39, so that the holder pivotal arm 20 engaging with the stopper member 30 is prevented from excessively pivoting downward. Thus, downward pivoting of the stopper member 30 in response to subsequent upward vertical movement (returning movement) of the movable side plates 8 causes the holder pivotal arm 20 to pivot upward to the initial pivotal position for enabling next egg reception.

FIGS. 7 and 8 schematically illustrate the operation of the shifting apparatus according to the present invention. These figures also show some possibilities for modifications.

In FIG. 7, the holders 18 (the eggs E) are indicated in solid lines as spaced from each other at the maximum pitch P2. Further, the holders 18 are indicated in phantom lines as spaced at the minimum pitch which is equal to the seating recess pitch P1 of the container 3. Such a pitch reduction is achieved by the pitch changing members 23 having the inclined guide surfaces 23a which cause the holders 18 to slide on the horizontal guide rods 17 against the pressing force of the coil springs 17. The eggs E are first supported by the respective holders 18, and then discharged into the respective seating recesses 3a of the container 3, as represented in FIG. 8.

As shown in FIG. 7, the rollers 27 illustrated in FIG. 1 may be replaced by slidable guided elements 27' which have inclined contact surfaces for contact with the inclined guide surfaces 23a of the pitch changing members 23. Further, instead of altering the inclination of the slanting guide surfaces 23a, the pitch changing members 23 may be made to translate back and forth for adjustment of the minimum pitch by horizontal cylinder devices 29', as indicated by double headed arrows D'.

As shown in FIG. 8, both pivotal arms 20 of each holder 18 may be controlled by two separate discharging mechanisms which respectively include elongated stopper members 30. Further, each slider 19 of the holder 18 may be slidably guided on a single horizontal guide rod 17 if this guide rod has a non-circular cross section to prevent rotation of the slider.

The present invention being thus described, it is obvious that the same may be modified in many other ways. For instance, the pitch changing members 23 may be arranged only on one stationary side plate 1 for simplification of overall construction. Further, each of the pitch changing devices 29 may be of the solenoid operated type or of the manual screw feed type. Such variations are not to be regarded as a departure from the spirit and scope of the invention, and all such modifications as would be obvious to those skilled in the art are intended to be included within the scope of the following claims.

I claim:

1. An apparatus for shifting objects, such as eggs, from an upper conveyor to each of containers transferred by a lower conveyor, the apparatus comprising:

substantially horizontal holder guide means arranged between said upper and lower conveyors;

displacing means for vertically moving said holder guide means between an upper position and a lower position;

a plurality of holders carried by said guide means for receiving a corresponding number of objects from said upper conveyor when said holder guide means assumes said upper position, said holders being slidable on said guide means and including two end holders;

spacer means for maintaining even spacing between said holders at least in said upper and lower positions of said holder guide means;

pitch changing means for causing said holders to slide on said holder guide means in response to vertical movement of said holder guide means in a manner such that said holders are spaced maximally from each other when said holder guide means assumes said upper position but spaced minimally from each other when said holder guide means assumes said lower position, said pitch changing means comprising inclined guide surface means arranged adjacent to at least one of said end holders for forcing said one end holder toward the other end holder as said holder guide means is vertically moved toward said lower position;

adjusting means for causing said inclined guide surface means to pivot about a pivotal axis located adjacent to said upper position of said holder guide means, thereby changing the inclination of said guide surface means; and discharging means for causing said holders to discharge the received objects into said container when said holder guide means assumes said lower position.

2. The shifting apparatus as defined in claim 1, wherein said one end holder carries roller means which comes into rolling contact with said inclined guide surface means.

3. The shifting apparatus as defined in claim 1, wherein said spacer means comprises springs interposed between said holders for urging them away from each other.

4. The shifting apparatus as defined in claim 1, said displacing means comprises a movable side plate provided for guided vertical movement and fixed to each end of said holder guide means, a cam follower mounted on said side plate, and a cam disc fixed eccentrically to a rotary cam shaft and contacting said cam follower from below.

5. The shifting apparatus as defined in claim 1, wherein said holder guide means comprises two pairs of parallel rods; and each holder comprises a pair of sliders each slidably supported on a corresponding pair of parallel rods, and a pair of holding arms pivotally mounted on the respective sliders in opposed relation to each other to define a receiving seat for a corresponding object, at least one holding arm of said arm pair being capable of assuming a first pivotal position for holding said corresponding object in said receiving seat, said one holding arm further being capable of assuming a second pivotal position for allowing said corresponding object to be discharged from said receiving seat into said container.

6. The shifting apparatus as defined in claim 5, wherein said discharging means functions to engage said one holding arm for keeping it in said first pivotal position when said holder guide means assumes said upper position, and to allow said one holding arm to pivot to said second pivotal position when said holder guide means assumes said lower position.

7. The shifting apparatus as defined in claim 6, wherein said discharging means includes fixed limit means which activates said discharging means so that said one holding arm is caused to pivot to said second pivotal position when said holder guide means assumes said lower position.

* * * * *